US008196361B1

(12) United States Patent
Ronsheim

(10) Patent No.: US 8,196,361 B1
(45) Date of Patent: Jun. 12, 2012

(54) STAIRWAY

(76) Inventor: Stephen E. Ronsheim, Columbus, IN (US)

( * ) Notice: Subject to any disclaimer, the term of this patent is extended or adjusted under 35 U.S.C. 154(b) by 18 days.

(21) Appl. No.: 12/984,824

(22) Filed: Jan. 5, 2011

Related U.S. Application Data

(62) Division of application No. 12/645,637, filed on Dec. 23, 2009, now Pat. No. 7,971,399.

(51) Int. Cl.
*E04F 11/00* (2006.01)
*E04F 19/10* (2006.01)

(52) U.S. Cl. ..... 52/188; 52/184; 52/191

(58) Field of Classification Search ..... 52/182, 52/184, 185, 186, 188, 191
See application file for complete search history.

(56) References Cited

U.S. PATENT DOCUMENTS

| | | | | |
|---|---|---|---|---|
| 4,018,300 | A * | 4/1977 | Geay | 182/194 |
| 4,118,908 | A * | 10/1978 | Bucher | 52/185 |
| 4,419,851 | A * | 12/1983 | Kruger | 52/184 |
| 4,619,084 | A * | 10/1986 | Snitman | 52/182 |
| 5,123,210 | A * | 6/1992 | Schmidt | 52/182 |
| 2010/0189493 | A1 * | 7/2010 | Aldstadt et al. | 403/168 |

* cited by examiner

*Primary Examiner* — William Gilbert
*Assistant Examiner* — Theodore Adamos
(74) *Attorney, Agent, or Firm* — Roberts IP Law; John Roberts

(57) ABSTRACT

A stairway having an alternating series of risers and treads wherein two risers and a tread form a step structure for use in constructing the stairway. The step structure including a first riser having a front portion and a rear portion, a tread having a support surface and an opposite surface, a second riser having a front portion and a rear portion, and wherein the tread is positioned between the rear portion of the first riser and the front portion of the second riser and wherein the second riser of one step structure becomes the first riser of the next-up step structure.

20 Claims, 22 Drawing Sheets

STAIRWAY

CROSS REFERENCES TO RELATED APPLICATIONS

This application is a divisional of application Ser. No. 12/645,637, filed Dec. 23, 2009 now U.S. Pat. No. 7,971,399, which is hereby incorporated by reference in its entirety.

BACKGROUND OF THE INVENTION

The construction of individual steps into a stairway offers a variety of options and challenges in terms of deciding upon and balancing the architecture and the aesthetics. In the most basic form, the series of steps needs to extend from a base or starting location to an elevated location. While there are suggested or required dimensions, sizes, spacings, etc., there are still a number of design options available. The "suggested" dimensions, sizes, spacings, etc. are typically based on human ergonomics and the ease of navigating up and down the stairway. The "required" dimensions, sizes, spacings, etc. would be influenced by, or perhaps the result of, any applicable building codes and/or construction guidelines. Throughout the design and construction process, the personal preferences and aesthetics still enter into the decision making process.

A further set of functional design considerations pertain to the requisite strength, durability, and load carrying capacity. Factored into these considerations is the reality that there may be multiple users at any one time and that the walking or stepping styles can induce vibration and cause variable loading at various locations along the stairway. In order to address these design considerations, the conventional construction of steps into a stairway typically uses one or more of the following: stringers, support structures, beams, and suspension cables, for example. However, these structural members often detract from the aesthetics of the individual step structures and the resulting stairway.

In terms of design versatility and desirable aesthetics, free-standing stairways are considered to be preferred or at least desirable due to their clean and uncluttered look. The counterpoint consideration is how to achieve the requisite strength, durability, and load carrying capacity without using any of the conventional or more commonly used structural members such as the aforementioned stringers, support structures, beams, and suspension cables.

The step structures, stairway configurations and features disclosed herein represent designs which achieve a balance between the aesthetics and the structural mandates, all in a novel and unobvious manner. Included as a part of the disclosed step structure and stairway configurations are a conventional stairway in terms of alternating risers and treads, a spiral stairway, a stairway with a plurality of (upper) landing options as well as none, and a bridge concept.

BRIEF SUMMARY

A stairway having an alternating series of risers and treads wherein two risers and a tread form a step structure for use in constructing the stairway. The step structure including a first riser having a front portion and a rear portion, a tread having a support surface and an opposite surface, a second riser having a front portion and a rear portion, and wherein the tread is positioned between the rear portion of the first riser and the front portion of the second riser and wherein the second riser of one step structure becomes the first riser of the next-up step structure.

One object of the present disclosure is to describe an improved stairway.

DETAILED DESCRIPTION

Figure 1:
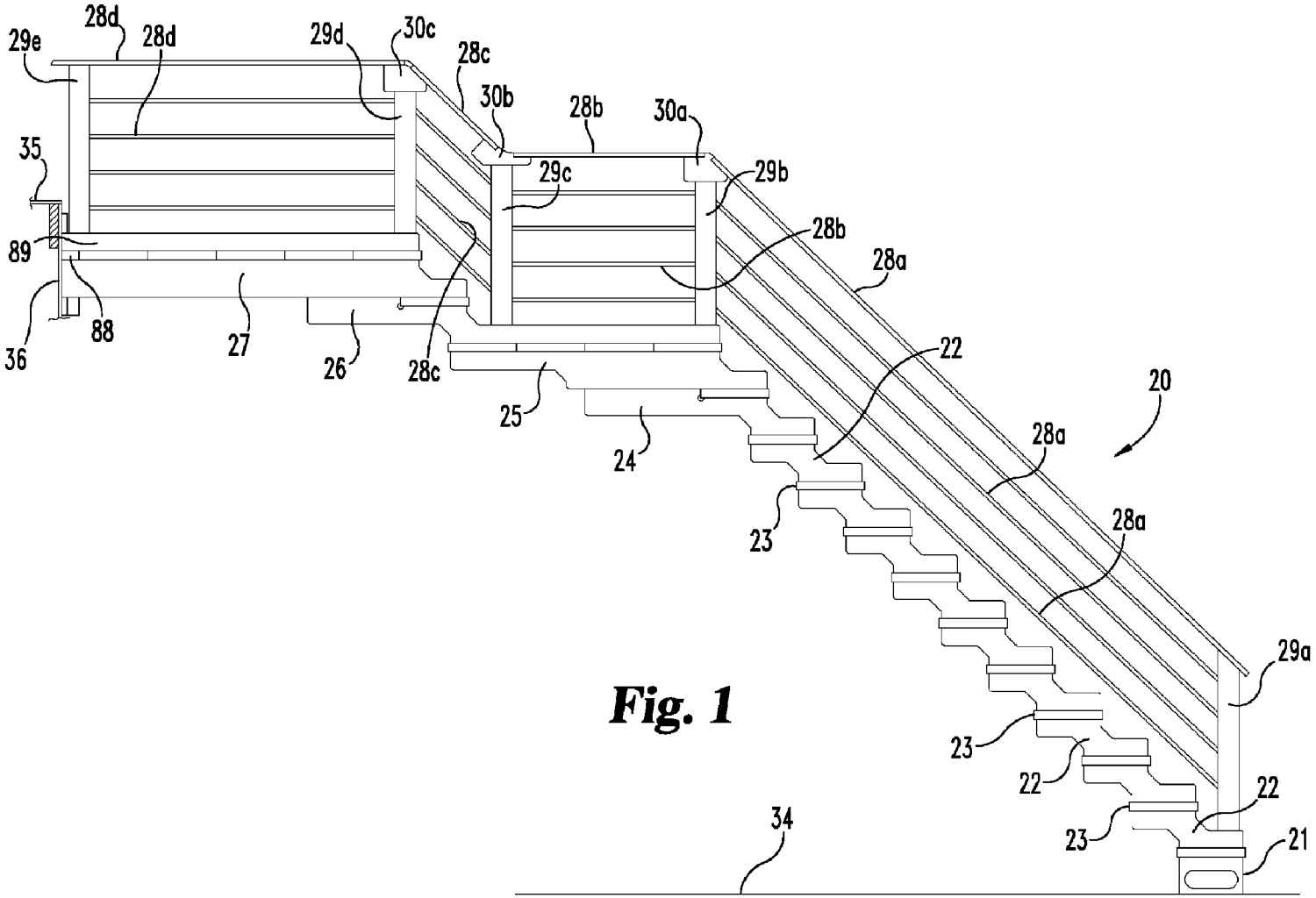
FIG. 1 is a side elevational view of a stairway according to one embodiment of the present disclosure.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Referring to FIGS. 1-5, there is illustrated a stairway 20 which includes a base 21, an alternating series of risers 22 and treads 23, and a series of tiered landings 24, 25, 26, and 27. Optionally included in cooperation with stairway 20 (and the landings) are hand railings 28*a*-28*d* which are supported by and secured to support posts 29*a*-29*e*. Although these various hand railings 28*a*-28*d* have essentially the same construction, the letter suffixes denote different locations and different lengths. Further included are support post caps 30*a*-30*c* which are rigidly attached to the corresponding support posts and which facilitate the connection of the adjacent (sequential) hand railings (top rung only). As illustrated, the uppermost hand railing 28*a* connects with the hand railing 28*b* via support post cap 30*a*. The opposite end of hand railing 28*b* connects with hand railing 28*c* via support post cap 30*b*. The opposite end of hand railing 28*c* connects with hand railing 28*d* via support post cap 30*c*. Support posts 29*a*-29*e* are drilled with receiving holes for inserting the remaining hand railings 28-28*d*.

FIGS. 1, 3, 4 and 5 illustrate stairway 20 as it would be seen by a user, without showing any of the mounting hole bodies as they extend through the various component parts and without showing any of the mounting hardware which in the preferred embodiment would be socket head cap screws and split lock washers. However, since it is important to fully understand what mounting holes are provided and where they are provided, FIGS. 1A and 2 provide this information, as diagrammatic illustrations. As would be understood, the counterbored clearance holes receive socket head cap screws which are threaded into the internally-threaded blind holes.

The lower rungs (four total) of hand railings 28*a*-28*d* are similarly and sequentially connected in series, as illustrated, utilizing the support posts 29*a*-29*d* as the connecting means. The final support post 29*e* provides the securing means for the final series of hand railings 28*d*.

It is important to note and to understand that the specific number, length, or height location and arrangement of the hand railings 28*a*-28*d* and the corresponding support posts 29*a*-29*e* are optional. Whether to use any of these component parts is also a design option. As such, the FIG. 1 stairway 20 is illustrated in FIGS. 2-5 without the use of any hand railings, support posts, or support caps. No other structural forms or components are illustrated in FIGS. 2-5 as being used with or required for stairway 20. This absence of any other structural forms or components depicts the clear and streamlined structure for stairway 20. This approach in construction also represents the ability of stairway 20 to exist in a fully functional, free-standing manner without the use of any other structural forms or components, except for base 21 and a means to secure the opposite end at the elevated location.

Figure 1A:
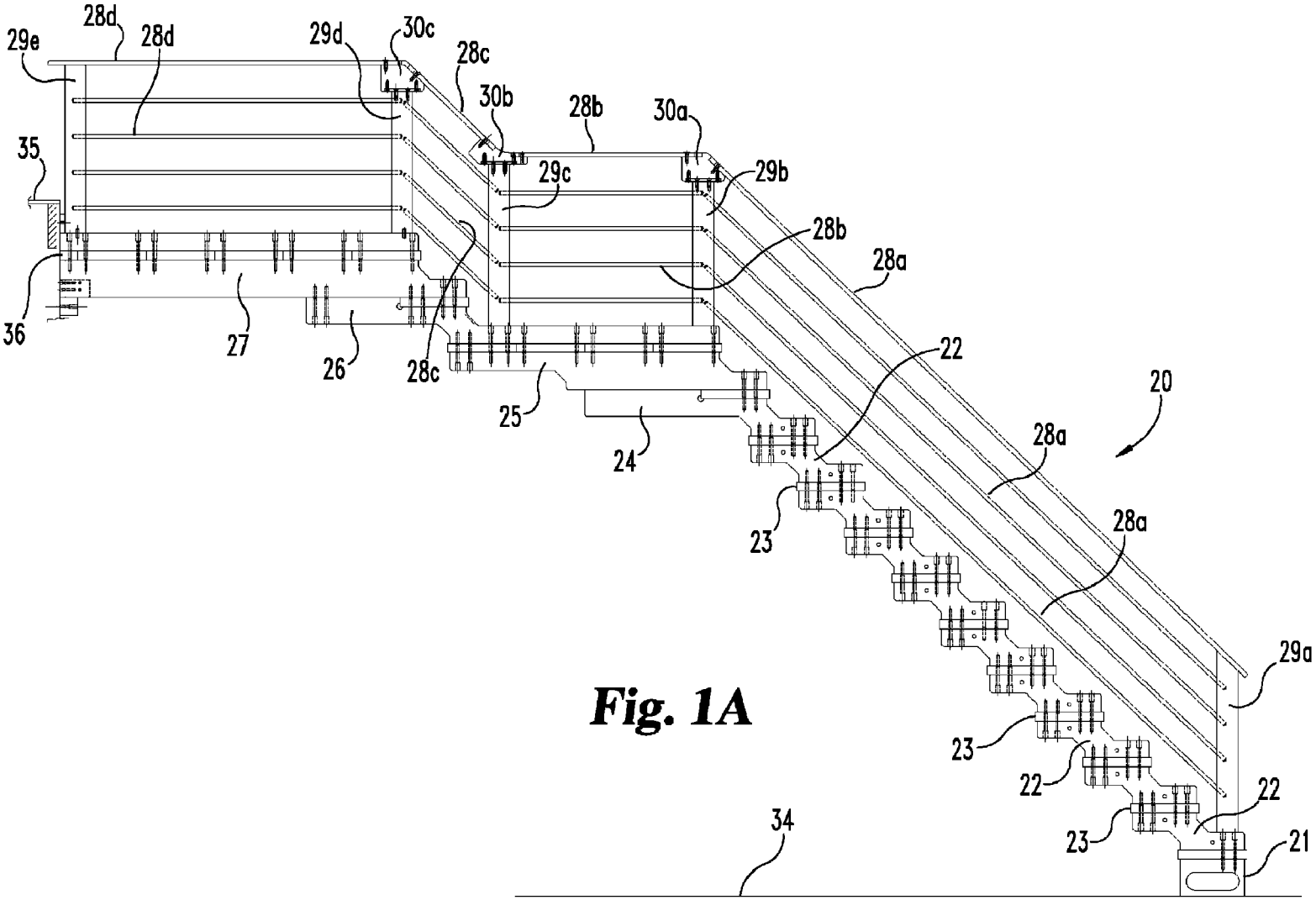
FIG. 1A is a schematic illustration of the FIG. 1 stairway with the mounting holes illustrated.
Figure 2:
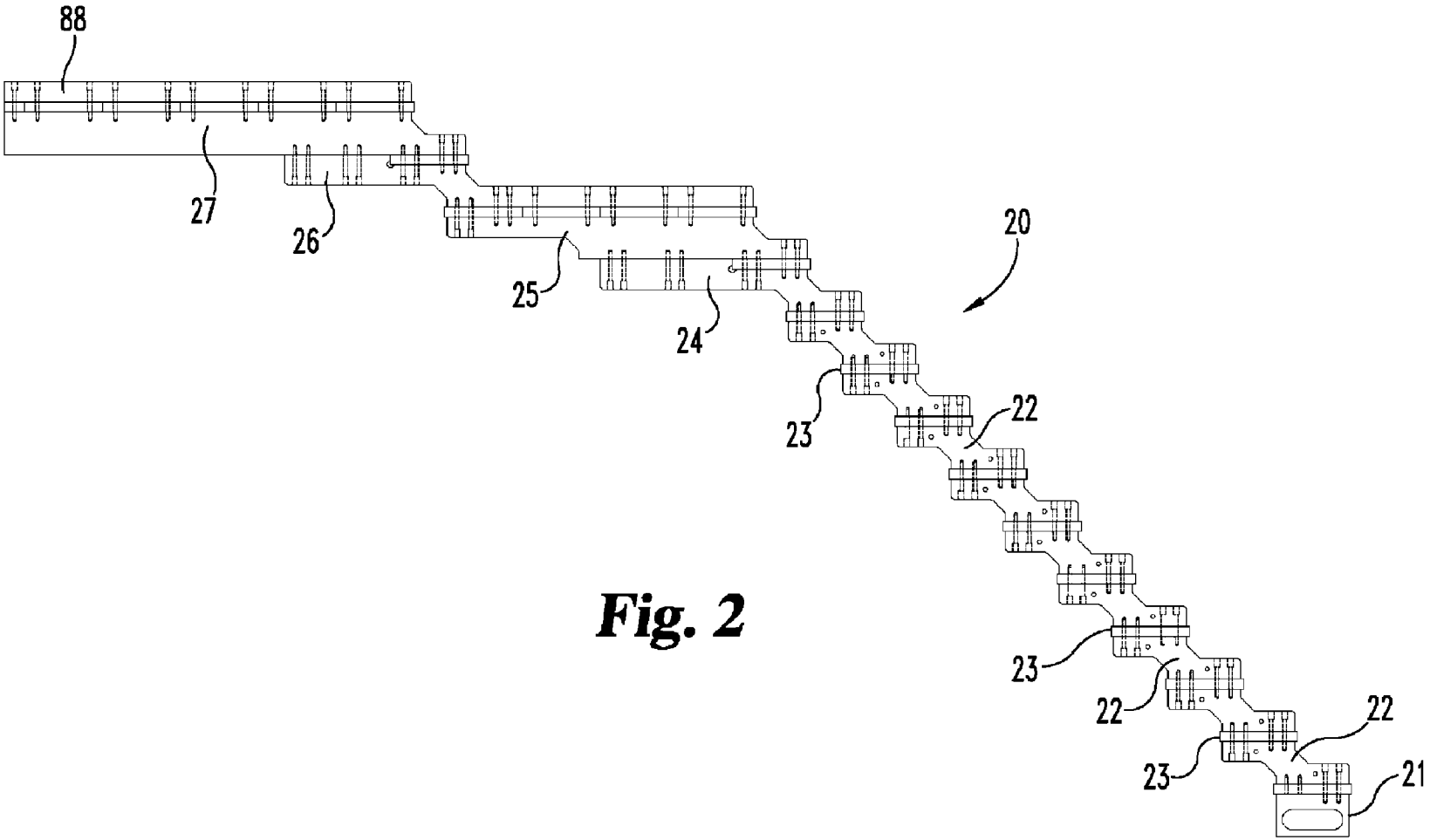
FIG. 2 is a side elevational view of the FIG. 1A schematic illustration omitting the hand railings and support posts.

With continued reference to FIGS. 1-5, surface 34 represents the floor of a structure in the FIG. 1 embodiment of stairway 20. However, surface 34 is generically representative of whatever floor, foundation, ground, or support surface receives base 21, if base 21 is utilized. Landings 24, 25, 26 and 27 are configured so as to provide a series of support surfaces of larger area for ease in transitioning into and reaching the elevated location 35 which denotes the end of the stairway 20. Whether one landing is used or a plurality of landings, the ending connection 36 is the same and is the preferred manner of ending the alternating series of risers 22 and treads 23 at the elevated location 35 when at least one landing is desired.

As used herein, the term "riser" refers to the structural portion of a step which provides the step-to-step elevation or height and the separation between adjacent treads. As used herein, the term "tread" refers to the generally horizontal member which provides the step surface upon which a user places his or her foot when walking up or down the stairway.

Figure 8:
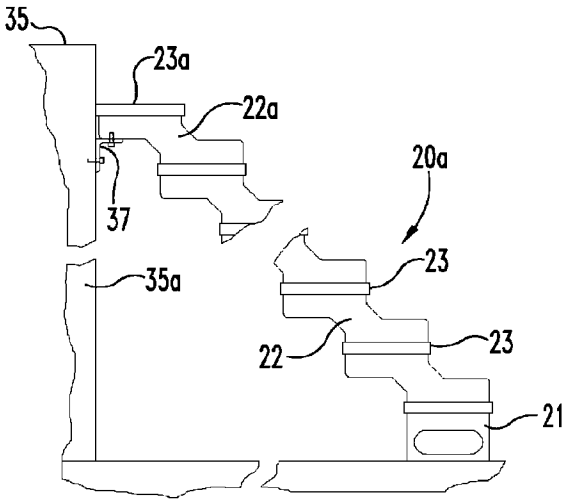
FIG. 8 is a partial side elevational view of an alternate stairway construction based on FIG. 1 without the use of the FIG. 1 landings.
Figure 11:
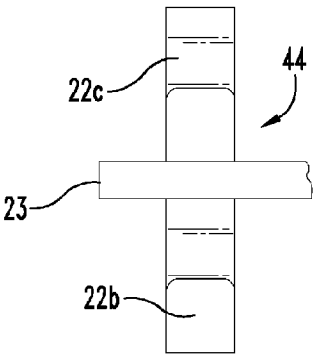
FIG. 11 is a front elevational view, with the tread in partial form, of the FIG. 9 step structure.

As noted, while the use of at least one landing likely provides a more traditional stairway configuration since stairways often have one or more landings, no landing is in fact required as part of stairway 20. The disclosed series of risers and treads can end with one step-up remaining in order to reach the ending destination at the elevated location. This particular stairway construction is illustrated as stairway 20*a* in FIG. 8. In FIG. 8, the last or ending riser 22*a* is securely anchored to vertical wall 35*a* by the use of L-shaped corner brackets 37 and appropriate bolting hardware, as is illustrated. The last or ending tread 23*a* is below the elevated location 35, typically a horizontal surface, such as a second floor of a structure. The spacing between last run 23*a* and surface 35 is approximately 8.25 inches which is the recommended step-to-step or tread-to-tread spacing.

Figure 5:
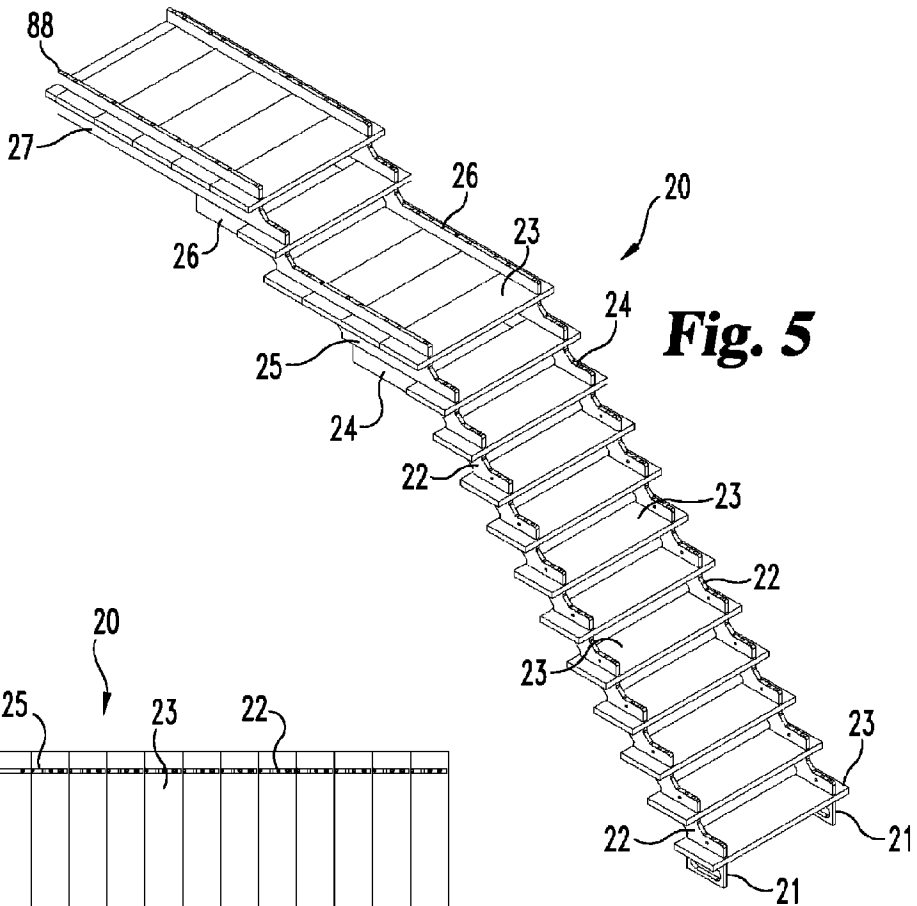
FIG. 5 is a perspective view of the FIG. 1 stairway.
Figure 4:
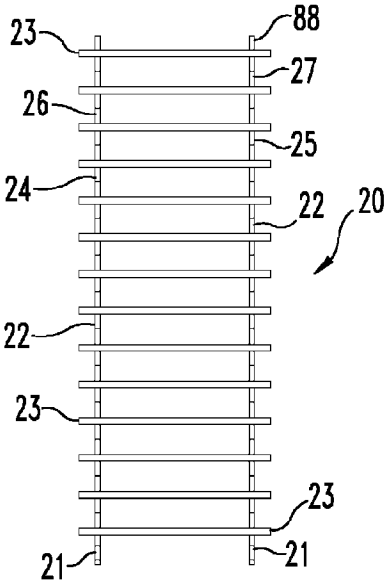
FIG. 4 is a front elevational view of the FIG. 1 stairway.
Figure 3:
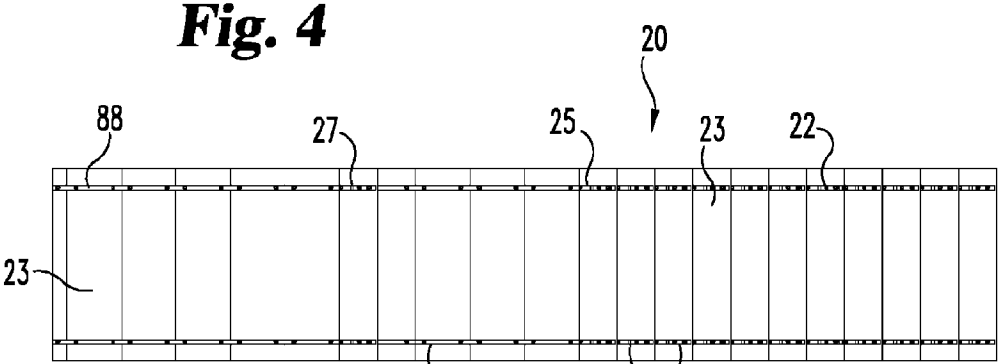
FIG. 3 is a top plan view of the FIG. 1 stairway without the hand railings and support posts.

As illustrated in FIGS. 3-5, there is one series of risers 22, each adjacent pair of risers 22 being spaced by a tread 23, on the left side of stairway 20, and a cooperating and aligned second series of risers 22 on the right side of stairway 20. The left and right side locations are based on the orientation when facing the stairway 20 from the front, ready for ascent. It should also be noted that the left side construction of stairway 20 is identical to the right side construction of stairway 20. As is illustrated, one pair of risers 22 sandwich a single tread 23 along a left edge of that tread and an aligned pair of right-side risers 22 sandwich the same tread 23 along a right edge of the tread 23. As is clear from the drawing illustrations and the descriptions herein, the lower riser provides support for the tread 23 while the upper riser sandwiches and clamps the tread 23 in position by using the mounting hardware to secure together the two adjacent risers with the tread 23 clamped therebetween. This particular configuration repeats itself in sequence from base 21 up to the first landing 24, with each riser 22 being positioned between adjacent treads 23. If multiple landings are used, as illustrated in FIGS. 1, 1A and 2, then landing 27 and its connection 36 to elevated location 35 denotes the end of stairway 20. However, as has been noted, the use of various landings is optional and, as illustrated in FIG. 8, the end of the alternating series of risers and treads could simply end at the elevated location (destination) and be mounted to a surrounding structure at that point.

Figure 6:
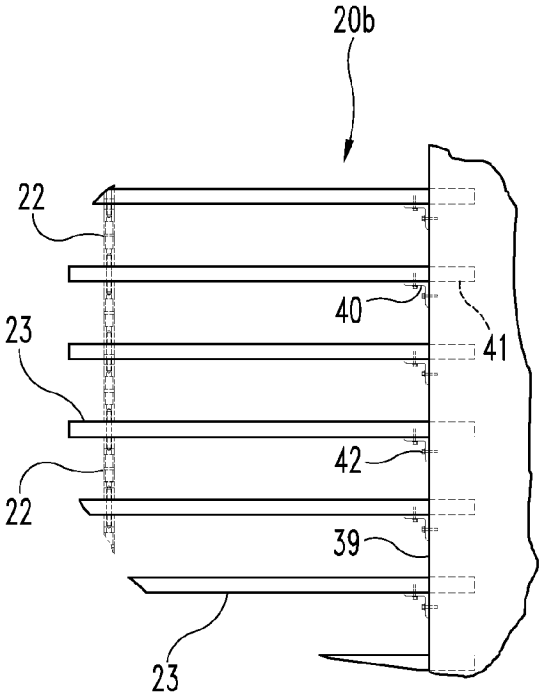
FIG. 6 is a front elevational view of an alternate mounting arrangement for the treads of the FIG. 1 stairway.
Figure 10:
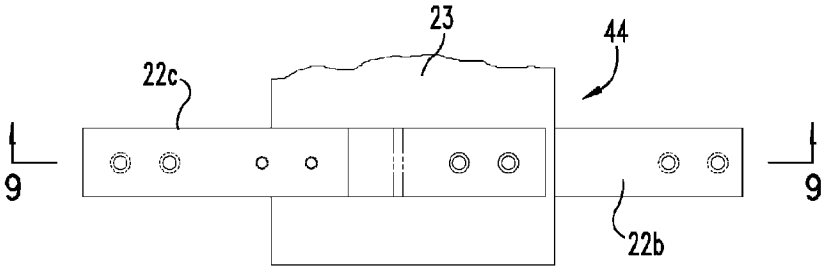
FIG. 10 is a top plan view of the FIG. 9 step structure.

FIG. 6 provides an alternative stairway 20*b* construction to what is illustrated in FIGS. 1-5. In FIG. 6, stairway 20*b* does not include the right side series of risers 22. Instead, the right side edge or portion of each tread 23 is anchored directly to the vertical wall 39. The illustrated anchoring structure shows the use of L-shaped corner brackets 40. One option is to notch or slot the wall 39 so as to be able to insert the free end of each tread 23 directly into a corresponding notch 41 for additional support. Depending on the construction of wall 39 and other factors such as the depth of insertion, the L-shaped corner brackets 40 would be considered optional, though most likely used for the added strength and rigidity which they provide. As is illustrated, threaded fasteners 42 are used to securely connect each corner bracket to a corresponding tread 23 and concurrently to wall 39.

Figure 7:
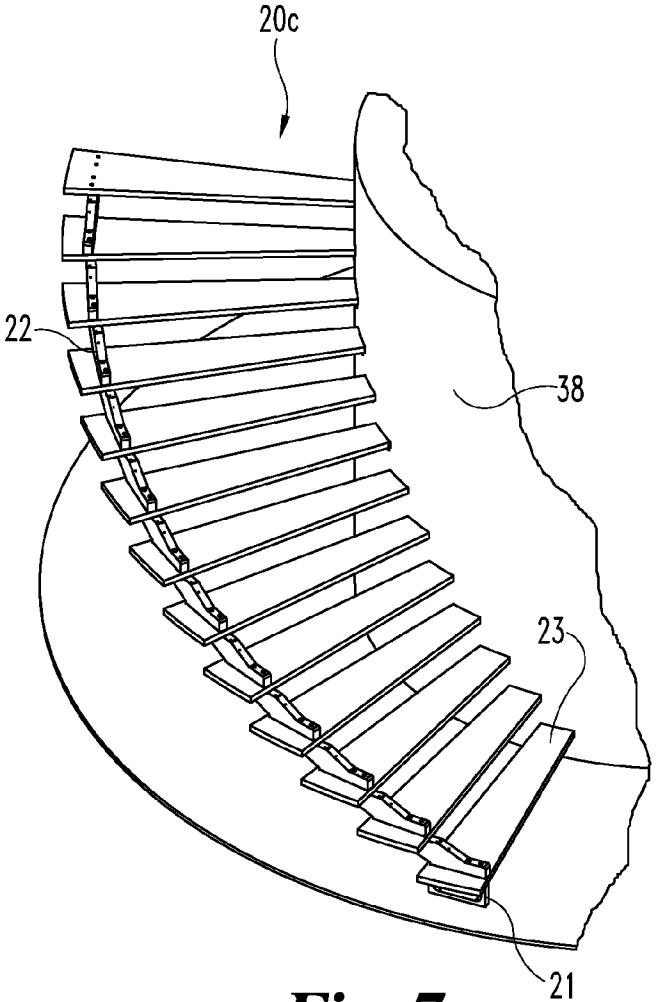
FIG. 7 is a partial perspective view of a spiral stairway according to another embodiment of the present disclosure.

Another option for the FIG. 6 construction (risers on only one side) is to apply it to a spiral stairway 20*c* (as illustrated in FIG. 7) which extends around an interior structure or wall, generically referred to as form 38. Essentially the same construction which is used in FIG. 6 is applied to stairway 20*c* as illustrated in FIG. 7. Since there is a radial or spoke configuration due to the generally cylindrical shape of the interior form 38, the risers 22 are turned slightly, as if to create short tangent lines which would be tangent to the outer diameter circle defined by the inner cylindrical size of form 38 and the radial length to the point where risers 22 are secured. Accordingly, each riser 22 is turned slightly so as to create the described tangent line and accordingly the mounting locations in the left end of each tread 23 are changed accordingly. If the treads 23 are only attached to the interior form 38 by brackets 40, then preferably the abutting right end surface of each tread 23 would be curved so as to fit flush up against the interior form 38. If not curved, there would still be contact, but not as aesthetically pleasing. If the treads 23 are inserted into receiving notches or slots, then the inserted end of each tread 23 can be left planar.

The focus of the present disclosure is directed to the construction of each riser 22 and the manner in which a tread 23 is sandwiched or clamped between adjacent risers 22 and secured in that manner by the use of the mounting hardware which is received by one riser, extends through the tread, and is anchored into the adjacent riser.

Referring to FIGS. 9, 10, 11 and 12, one side or end of a step structure 44 is illustrated. When risers are used at each end of each tread (see FIGS. 1-5), the structure of FIGS. 9-12 is duplicated at the opposite end of the corresponding tread 23. When risers 22 are only used on one end of each tread 23 (see FIG. 6), the structure of FIGS. 9-12 is limited to only one end or side of each tread 23. What is illustrated in FIG. 6 could just as well be reversed wherein the right side includes the risers 22 and the left side is secured to a wall. Each step structure 44 includes a first (lower) riser 22*b*, a second (upper) riser 22*c*, and a tread 23 positioned between the first and second risers 22*b* and 22*c*, respectively.

Each riser 22 (including risers 22*b* and 22*c*) is constructed and arranged with a first (lower) portion 45 and an offset or staggered second (upper) portion 46. Focusing on the mounting hole locations for the socket head cap screws 52 which are used, lower portion 45 is the same as upper portion 46, only inverted. Broken lines 47*a* and 47*b* define connecting portion 43. The result is that each riser 22 has its one portion 45 being offset from the other portion 46 in both horizontal (run) and vertical (rise) directions. The amount or extent in each direction being controlled by the size and shape of connection portion 43 and the angle or incline of lines 47*a* and 47*b* which define the size and shape of the connecting portion 43. The tread 23 is positioned between the upper portion 46 of the lower riser 22*b* and the lower portion 45 of the upper riser 22*c*. In terms of a step structure which includes two risers and a tread, the lower portion 45 is considered to be a "front" portion based on facing the stairway or staircase ready for ascent. The upper portion 46 is considered to be a "rear" portion using the same convention and frame of reference.

Figure 9:
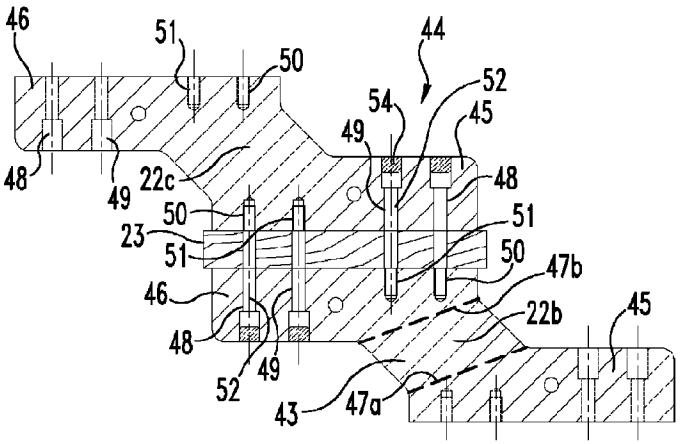
FIG. 9 is a side elevational view, in full section, of a step structure, as used in FIG. 1, according to the present disclosure.
Figure 12:
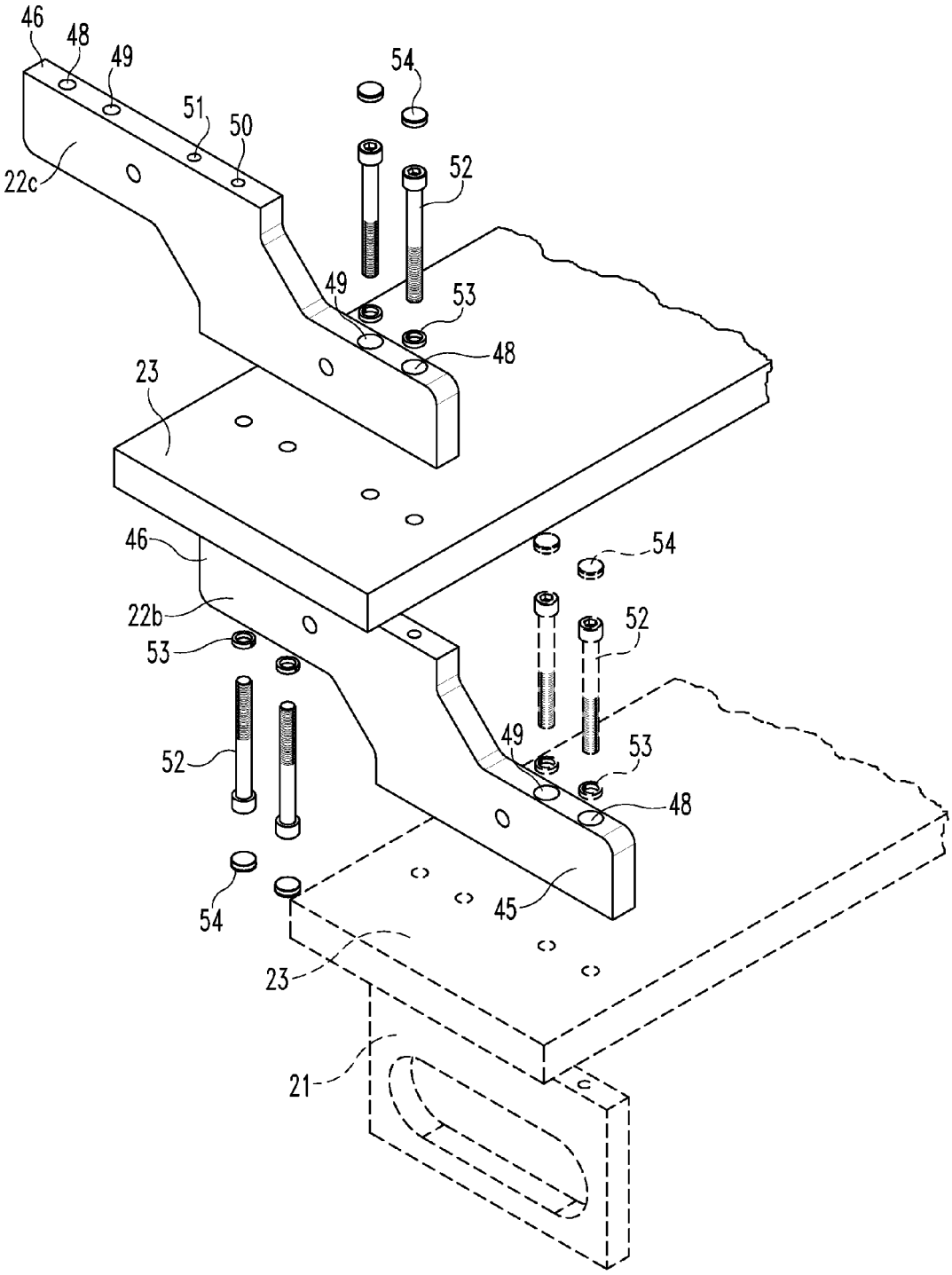
FIG. 12 is a partial, perspective, exploded view of the FIG. 9 step structure.
Figure 14:
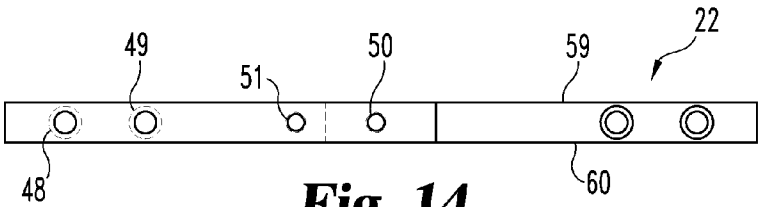
FIG. 14 is a top plan view of the FIG. 13 riser.
Figure 13:
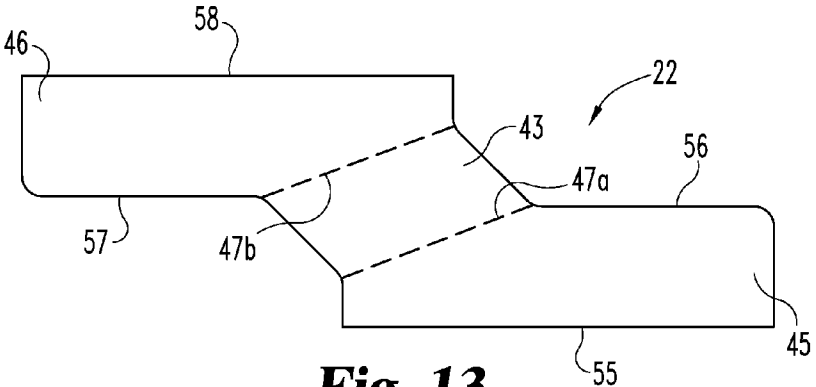
FIG. 13 is a side elevational view of a riser comprising a portion of the FIG. 1 stairway.
Figure 15:
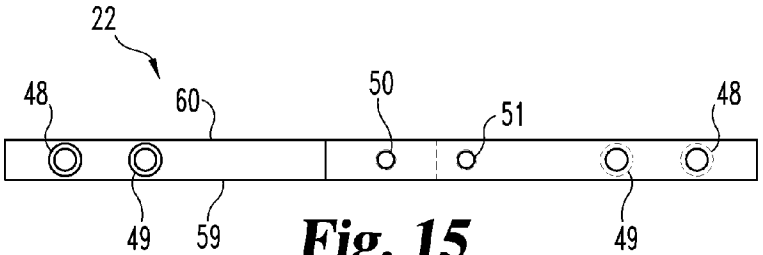
FIG. 15 is a bottom plan view of the FIG. 13 riser.
Figure 16:
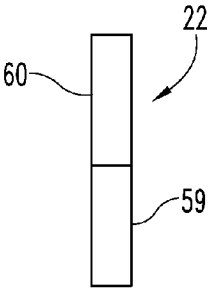
FIG. 16 is a front elevational view of the FIG. 13 riser.
Figure 17:
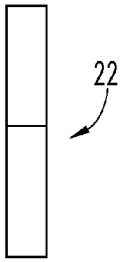
FIG. 17 is a rear elevational view of the FIG. 13 riser.

The full section view of FIG. 9 shows that each portion 45 and 46 of each riser 22 includes two counterbored, through bolt holes 48 and 49. Each riser portion 45 and 46 also includes two internally-threaded blind holes 50 and 51. Since riser 22*b* is offset or staggered both vertically and horizontally from the other riser 22*c*, the two bolt holes 48 and 49 through the upper portion 46 of the lower riser 22*b* are axially aligned with the internally-threaded blind holes 50 and 51 of the lower portion 45 of the upper riser 22*c*. At the same time, the two bolt holes 48 and 49 of the lower portion 45 of the upper riser 22*c* are axially aligned with the two internally-threaded blind holes 50 and 51 of the upper portion 46 of the lower riser 22*b*. All of this is further illustrated in the exploded view of FIG. 12. Also illustrated in FIG. 12 are the socket head cap screws 52, split lock washers 53, and decorative cap plugs 54.

The tread 23 which is sandwiched between the two risers 22*b* and 22*c* includes four clearance holes for receiving the securing hardware, preferably socket head cap screws 52 for the pair of risers. If the arrangement of FIGS. 1-5 is selected, the tread 23 includes four clearance holes in each end of the tread 23 as the structure of FIGS. 9-12 is repeated on the opposite end of the tread 23. If the FIG. 6 arrangement is selected, then the left end of the tread 23 has these four clearance holes and the opposite (right) end has mounting provisions for the corner brackets 40. If the reverse of FIG. 6 is selected, then the four clearance holes are on the right end of the tread.

The step structure 44 is assembled by inserting two socket head cap screws 52 through holes 48 and 49 of the lower portion 45 of the upper riser 22*c* and threading each socket head cap screw 52 into a corresponding internally-threaded hole 50, 51 in the upper portion 46 of the lower riser and tightening each socket head cap screw into a secure clamping condition. Either before or after the foregoing described step, two socket head cap screws 52 are inserted through holes 48 and 49 of the upper portion 46 of the lower riser 22*b* and threaded into corresponding internally-threaded holes 50, 51 in the lower portion 45 of the upper riser 22*c*. These two socket head cap screws are tightened into a secure clamping condition.

Although FIGS. 9-12 illustrate what has been described as a step structure 44, a "step" includes a riser 22 and a tread 23 and the next tread begins a new "step". The step height or rise height is conventionally defined as the distance from the top of one tread to the top of the next-up tread. Since each tread 23 is sandwiched between two risers 22, it is important to explain this construction concept in terms of a step module which is called step structure 44. The alternating sequence of treads 23 and risers 22, as illustrated, extends from base 21 to the elevated location 35, conditioned upon whether one or more landings are incorporated. Since the finished stairway may include one or more landing levels, as illustrated in FIG. 1, or none at all, as illustrated in FIG. 8, it is important to characterize the stairway as predominantly including the alternating series of treads and risers, since those are the fundamental or essential building blocks for stairway 20. Accordingly, and as noted, the focus of the present disclosure is on the step structure 44 and its construction which enables the fabrication and use of free-standing stairway 20, including the other stairway constructions disclosed herein, all in a safe and secure manner.

In terms of step structure 44 and the alternating series of treads 23 and risers 22, it should be noted that the upper riser for the first tread becomes the lower riser for the "next-up" tread. This sequence or pattern repeats itself for the stairway construction disclosed herein.

Referring now to FIGS. 13-17, the details of a single riser 22 are illustrated. Each riser includes, as already noted, a first or lower portion 45 and a second or upper portion 46. Based on the location established for broken lines 47*a* and 47*b*, these two portions 45 and 46 are substantially identical and simply inverted and shifted horizontally. Each portion 45 and 46 includes or defines the above-noted clearance holes 48 and 49 and the internally-threaded blind holes 50 and 51. Riser 22 is preferably a unitary, metal component.

Portion 45 includes a lowermost planar surface 55 and an uppermost planar surface 56 which is substantially parallel with surface 55. Portion 46 includes a lowermost planar surface 57 and an uppermost planar surface 58 which is substantially parallel with surface 57. Further, surfaces 56 and 57 are substantially parallel to each other, but not necessarily co-planar. Whether or not these surfaces are co-planar depends on the size and shape of connecting portion 43. Each hole 48, 49, 50 and 51 has a longitudinal or axial centerline and each axial centerline is substantially parallel with the other three and each axial centerline is substantially perpendicular to each surface 55-58. As illustrated in FIGS. 9-12, tread 23 rests on surface 58 in a substantially horizontal orientation and is sandwiched or clamped between surface 58 of the lower riser and surface 55 of the adjacent, next-up riser. These references to "lowermost" and "uppermost" are based on the riser orientation when used in a stairway (see FIG. 1) and pertain to the corresponding portions 45 and 46. However, surface 55 is also the lowermost surface of the entire riser 22 and surface 58 is also the uppermost surface of the entire riser 22.

Each riser 22 has a uniform thickness throughout and planar sides 59 and 60 are substantially perpendicular to surfaces 55-58. The angled connecting portion 43 creates a more gradual transition between portions 45 and 46 which would otherwise likely include sharp interior corners. As such, connection portion 43 helps to reduce stress concentrations which might otherwise exist.

Figure 18:
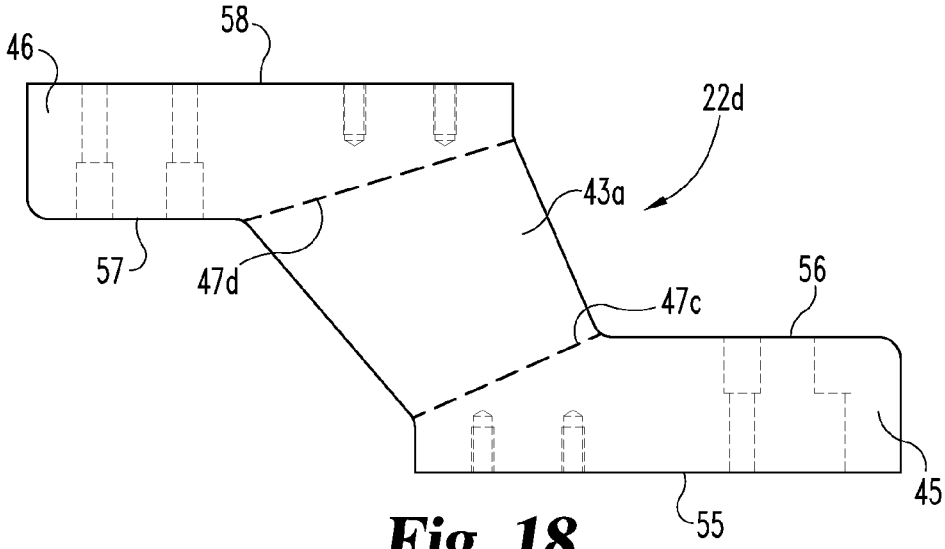
FIG. 18 is a side elevational view of an alternate riser configuration suitable for use in the FIG. 1 stairway as a replacement for the FIG. 1 riser.

Referring to FIG. 18, an alternative riser style is illustrated wherein the connection portion 43*a* is changed from that of riser 22. For riser 22*d*, the connection portion 43*a* is larger and has a different degree of angularity between lines 47*c* and 47*d* which define the bounds of portion 43*a*. This drawing is provided in order to illustrate the effect the connection portion has on the positional relationship between portions 45 and 46 when the basic structural features of these two portions 45 and 46 do not otherwise change.

Figure 19:
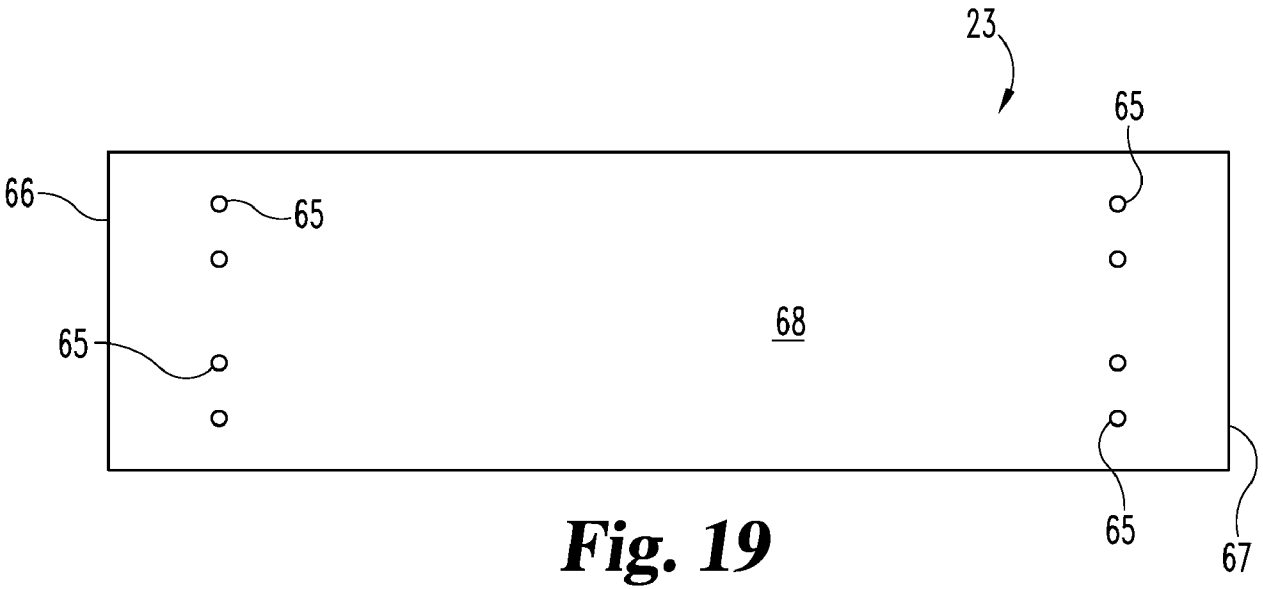
FIG. 19 is a top plan view of a tread comprising one portion of the FIG. 1 stairway.
Figure 21:
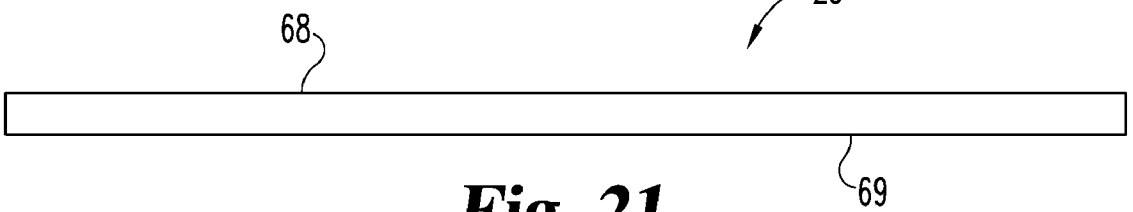
FIG. 21 is a front elevational view of the FIG. 19 tread.
Figure 20:
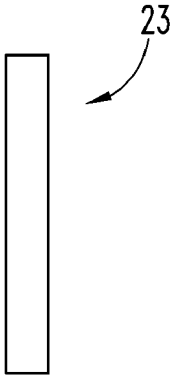
FIG. 20 is an end elevational view of the FIG. 19 tread.

Referring now to FIGS. 19-21, the details of tread 23 are illustrated. The tread 23 which is illustrated assumes that risers will be used at each end (based on the stairway 20 construction of FIGS. 1-5). Accordingly, four clearance holes 65 are defined by the left end 66 of tread 23 and four clearance holes 65 are defined by the right end 67 of tread 23. The four holes 65 of one end are longitudinally aligned with the four holes 65 of the opposite end. This maintains the overall symmetry and balance which is expected and which would be typical for stairway constructions based on the use of repetitive component parts in an alternating sequence. Tread 23 is preferably a unitary member and the material choices include woods, metals, plastics, composites, and combinations of the above.

Each tread 23 is a substantially rectangular member which includes an upper planar surface 68, a lower planar surface 69, and four defining sides. Preferably, the sides are at right angles and the tread has a generally uniform thickness. Surfaces 68 and 69 are substantially parallel to each other and this construction in cooperation with the risers helps to maintain the squareness, parallelism, and perpendicularity of stairway 20. When a spiral stairway is constructed, such as stairway 20*c*, the locations of holes 65 will change due to the alignment of the risers 22. The shape of edge 67 might also change, depending on the selected technique for attachment, as has been described.

Figure 22:
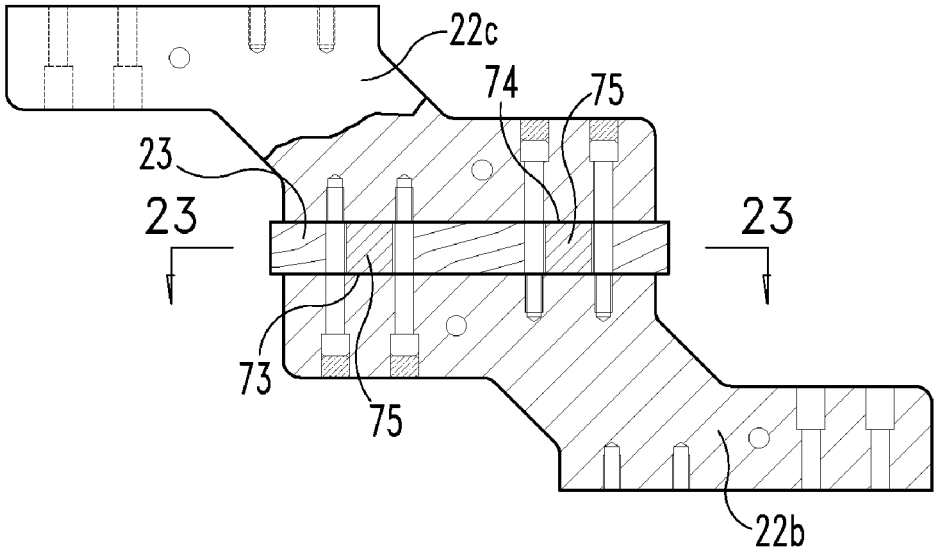
FIG. 22 is a side elevational view, in full section, of an alternate step structure utilizing a compression spacer.
Figure 23:
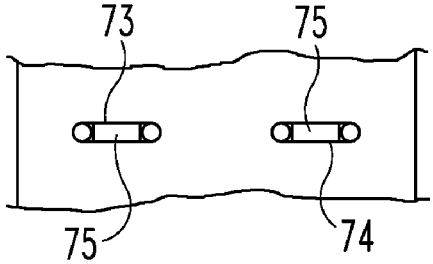
FIG. 23 is a partial, full section view, of the FIG. 22 step structure, as viewed along line 23-23 in FIG. 22.

Referring now to FIGS. 22 and 23, a further option for stairway 20 and for step structure 44 is illustrated. Since the upper riser 22*c* and the lower riser 22*b* are bolted together, clamping the tread 23 therebetween, the tightening torque on the socket head cap screws 52 could overstress the tread, depending on the thickness and selected material for each tread 23. If there is a concern that the clamping force exerted by the two risers on the tread would be too high, based on tightening of the socket head cap screws, the alternative tread style represented by tread 72 includes a pair of through slots 73 and 74 in each end. Slots 73 and 74 are defined by starting with the locations of holes 65 of tread 23 and machining out the material between each pair of holes 65. The next step is to insert in between the two hole locations a compression spacer 75. This enables the ends of each slot 73 and 74 to still provide a full clearance bore for the socket head cap screws 52. The compression spacer 75 which is placed in between the two hole locations as part of this opened slot is a solid block of metal or similar material which is designed to be more rigid and stronger (i.e., less compressible) than the selected tread material. Further, compression spacer 75 has an overall thickness which is substantially equal to the thickness of each tread at the clamping locations where the socket head cap screws 52 are inserted. By making the thickness of the compression spacer 75 slightly less than the tread thickness in the clamping areas, some compression on the tread will occur. This keeps the tread from moving or being loose. The use of compression spacers 75 limits or controls the amount of tread compression.

Figure 26:
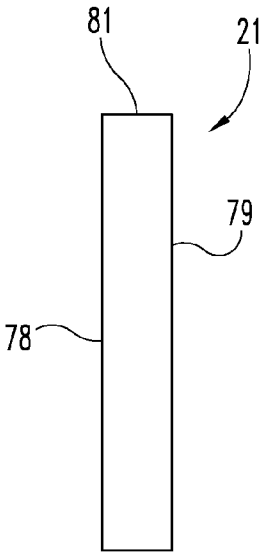
FIG. 26 is a front elevational view of the FIG. 24 base.
Figure 25:
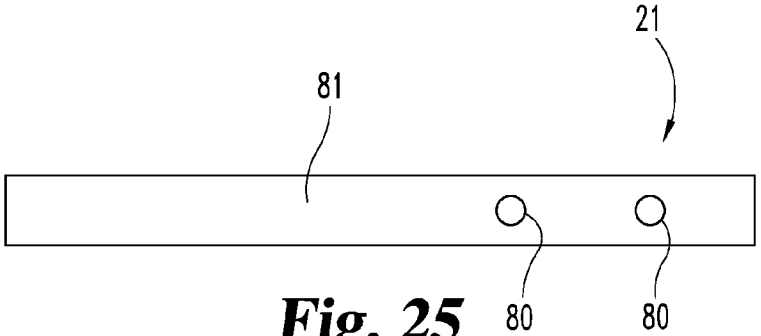
FIG. 25 is a top plan view of the FIG. 24 base.
Figure 24:
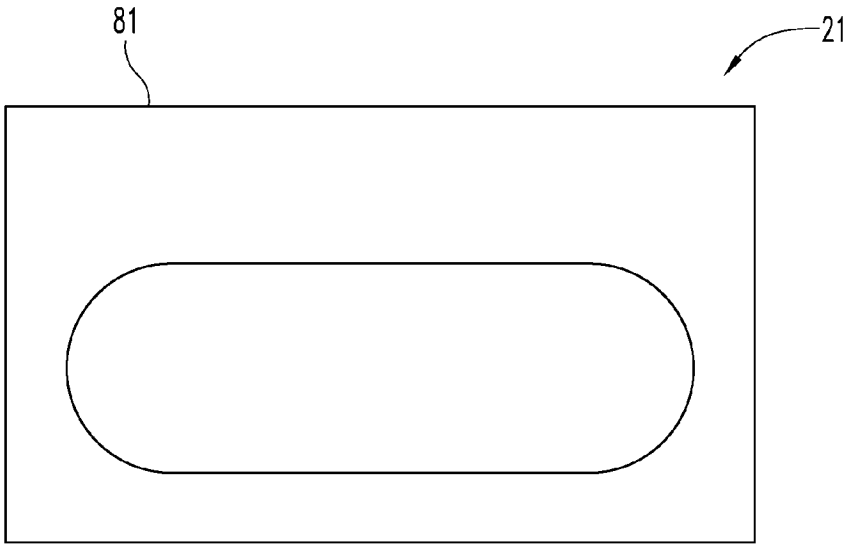
FIG. 24 is a side elevational view of a base comprising one portion of the FIG. 1 stairway.
Figure 31:
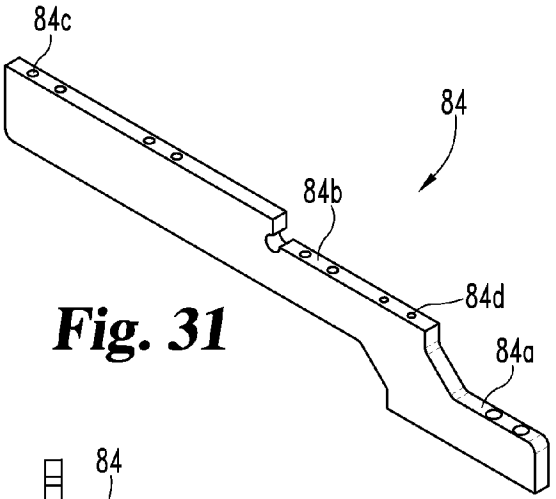
FIG. 31 is a perspective view of the FIG. 27 landing riser.
Figure 30:
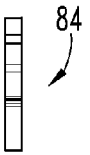
FIG. 30 is a front elevational view of the FIG. 27 landing riser.
Figure 28:
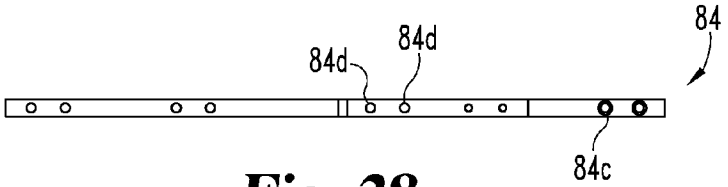
FIG. 28 is a top plan view of the FIG. 27 landing riser.
Figure 27:
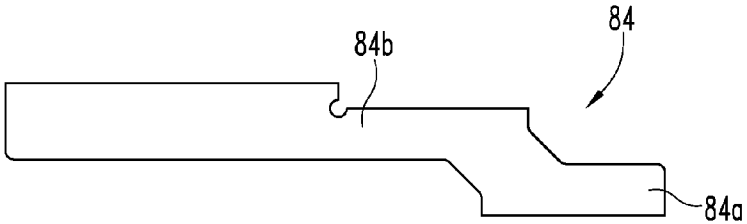
FIG. 27 is a side elevational view of a landing riser comprising one portion of the FIG. 1 stairway.
Figure 29:
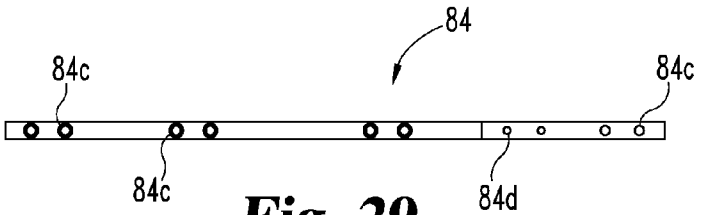
FIG. 29 is a bottom plan view of the FIG. 27 landing riser.
Figure 36:
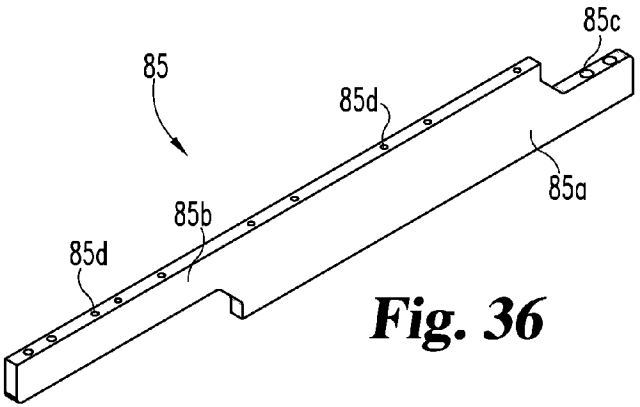
FIG. 36 is a perspective view of the FIG. 32 landing riser.
Figure 35:
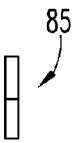
FIG. 35 is a front elevational view of the FIG. 32 landing riser.
Figure 33:
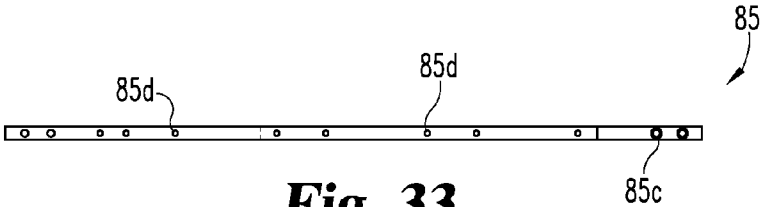
FIG. 33 is a top plan view of the FIG. 32 landing riser.
Figure 32:
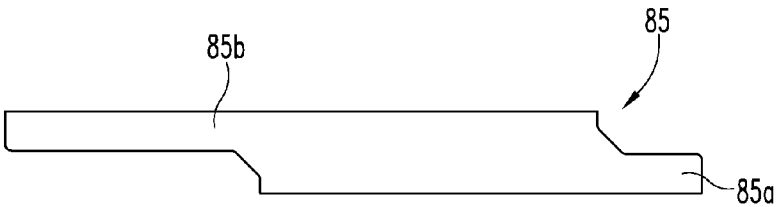
FIG. 32 is a side elevational view of a second landing riser comprising one portion of the FIG. 1 stairway.
Figure 34:
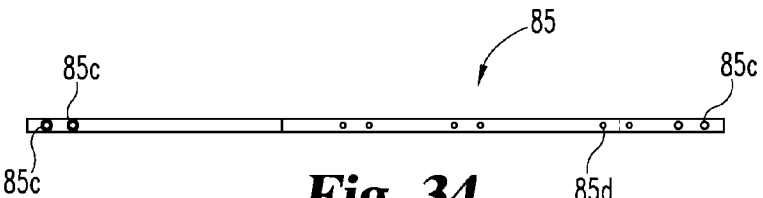
FIG. 34 is a bottom plan view of the FIG. 32 landing riser.
Figure 41:
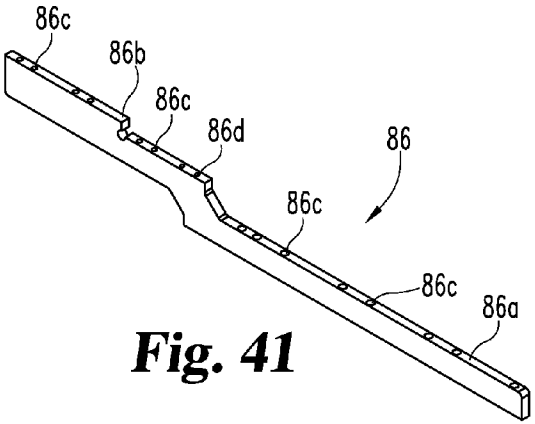
FIG. 41 is a perspective view of the FIG. 37 landing riser.
Figure 40:
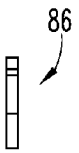
FIG. 40 is a front elevational view of the FIG. 37 landing riser.
Figure 38:
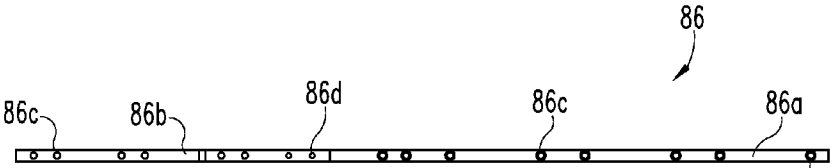
FIG. 38 is a top plan view of the FIG. 37 landing riser.
Figure 37:
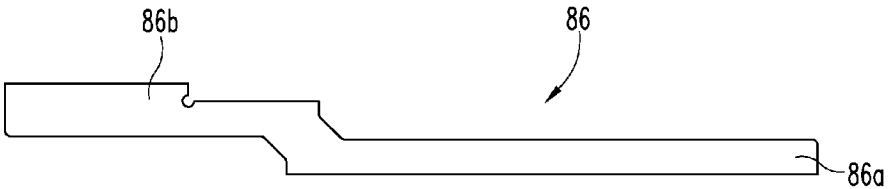
FIG. 37 is a side elevational view of a third landing riser comprising one portion of the FIG. 1 stairway.
Figure 39:
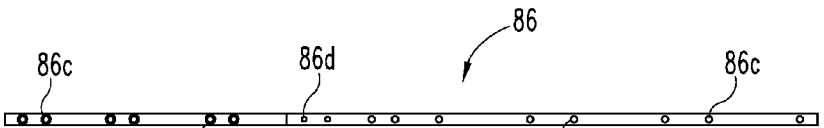
FIG. 39 is a bottom plan view of the FIG. 37 landing riser.
Figure 46:
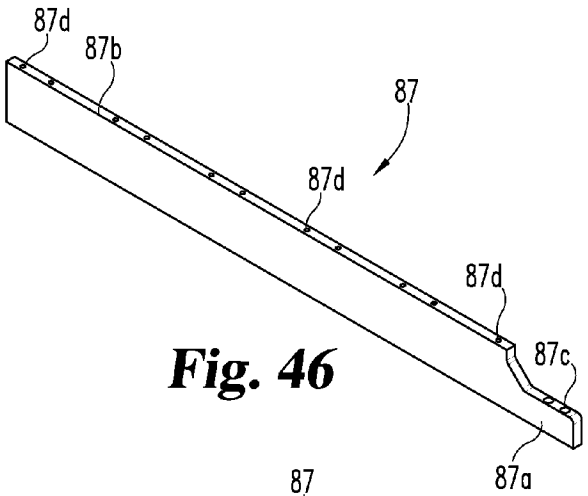
FIG. 46 is a perspective view of the FIG. 42 landing riser.
Figure 45:
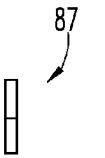
FIG. 45 is a front elevational view of the FIG. 42 landing riser.
Figure 43:
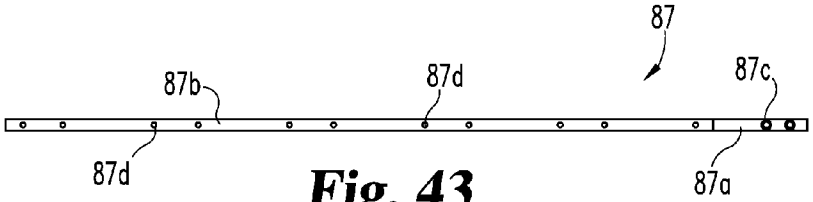
FIG. 43 is a top plan view of the FIG. 42 landing riser.
Figure 42:
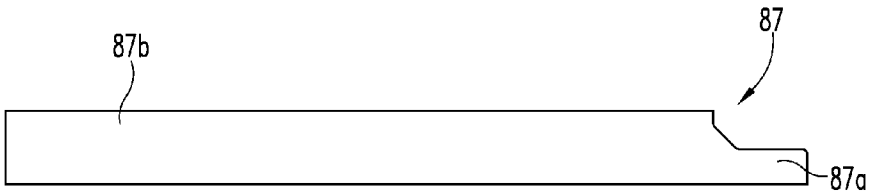
FIG. 42 is a side elevational view of a fourth landing riser comprising one portion of the FIG. 1 stairway.
Figure 44:
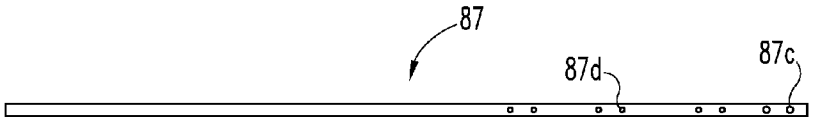
FIG. 44 is a bottom plan view of the FIG. 42 landing riser.
Figure 51:
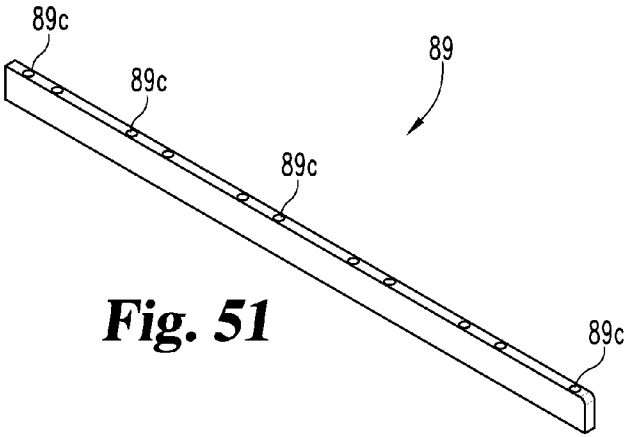
FIG. 51 is a perspective view of the FIG. 47 clamping riser.
Figure 50:
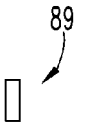
FIG. 50 is a front elevational view of the FIG. 47 clamping riser.
Figure 48:
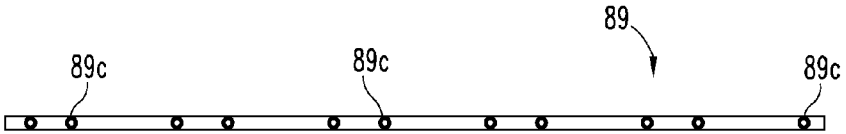
FIG. 48 is a top plan view of the FIG. 47 clamping riser.
Figure 47:
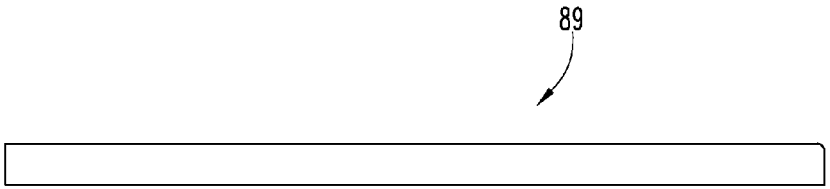
FIG. 47 is a side elevational view of a clamping riser comprising one portion of the FIG. 1 stairway.
Figure 49:
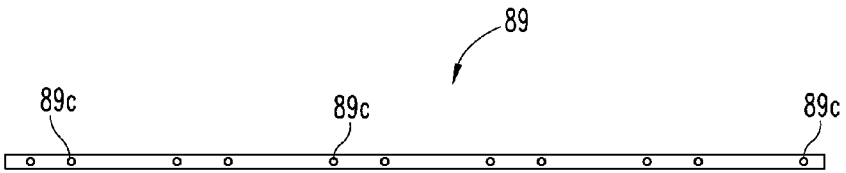
FIG. 49 is a bottom plan view of the FIG. 47 clamping riser.

Referring now to FIGS. 24-26, the details of base 21 are illustrated. Base 21 provides the support member for the start of stairway 20 relative to the floor or other support structure 34. Base 21 may be anchored to structure 34 or left unanchored. Since the first run 23 needs to be elevated above the floor 34 at the correct or desired ergonomic height, in order to start the ascent, base 21 provides this initial spacing or offset as well as a means of anchoring the start of stairway 20 to its foundation surface, in this instance floor 34. For stairway 20, one base 21 is used on each side of the stairway, as illustrated and consistent with FIGS. 1-5.

Base 21 is a metal member of generally uniform thickness, having substantially parallel sides 78 and 79. Internally-threaded holes 80 are provided in the upper surface 81 and are used to secure the first tread 23 in position. This first tread 23 is clamped between base 21 and the first riser 22.

As described in conjunction with the explanation of stairway 20 as illustrated in FIGS. 1-5, provisions are made so as to incorporate one or more landings adjacent the upper end of the steps (i.e., riser and tread combination). While the number of landings as well as the shape and surface area of each landing remains a design option or variable, it is also a design option or variable to not have any landings, as would be illustrated by the FIG. 8 structure.

In the FIG. 1 construction of stairway 20, landings 24, 25, 26, and 27 are illustrated. Each landing is a combination of landing risers and one or more treads 23. The treads 23 used for the landings are the same as the treads used in alternating sequence with risers 22. While the term "landing" might be thought of as only the horizontal platform which has a surface area greater than that of a single tread, as that term is used herein, it is intended to refer to the combination of risers and treads as assembled together. For each landing, the landing risers are used on both sides of the treads unless the treads are directly anchored to or into a wall.

With continued reference to FIG. 1, landing 24 includes landing riser 84 (see FIGS. 27-31) supporting a single riser 23. This construction is referred to as a landing due to the use of a landing riser 84, even though the support surface area is a single tread 23. This single tread 23 is clamped in position by the lower (front) portion of landing riser 85 (see FIGS. 32-36). The upper portion of landing riser 85 supports four treads 23 which are abutted together to create an uninterrupted support surface. These four treads 23 are clamped in position by the lower (front) portion of landing riser 86 (see FIGS. 37-41). The upper portion of landing riser 86 supports a single tread 23. This single tread 23 is clamped in position by the lower (front) portion of landing riser 87 (see FIGS. 42-46). The upper portion of landing riser 87 supports five treads 23 which are abutted together in order to create an uninterrupted support surface. If the length of the upper tread supporting edge of landing riser 87 is not a multiple of the individual tread width (front to rear dimension), then a filler tread strip, such as strip 88, is used to complete the support surface. Clamping riser 89 (see FIGS. 47-51) is used to clamp the five treads 23 and the tread strip 88 into position.

The landing risers 84-87 each include a corresponding arrangement of counterbored clearance holes and internally-threaded blind holes. The number of holes, the type, and the pattern are selected based on the number of treads 23 supported by the landing riser and based on the number of treads 23 being clamped by the landing riser. Consistent with the assembly of risers 22 and treads 23, socket head cap screws are used for the assembling and clamping of the various treads 23 between the identified landing risers 84-87 as well as including use of clamping riser 89. The only differences to this repeating pattern of riser and tread assembly are the starting (lower end) location where landing riser 84 clamps the thread to a conventional riser 22 and, at the elevated ending location, where clamping riser 89 does not support any tread. Since clamping riser 89 does not support any tread, it only includes counterbored clearance holes.

In order to simplify the understanding of the landing riser drawings, a, b, c, and d suffixes are used with the base landing riser or clamping riser reference number in order to identify the structural portions of each landing riser or clamping riser and the type of mounting hole. More specifically, the "a" suffix (such as 84*a*) identifies the lower (front) portion, the "b" suffix identifies the upper portion, the "c" suffix identifies the counterbored clearance holes, and the "d" suffix identifies the internally-threaded blind hole. According to this numbering approach, FIGS. 27-31 include reference numbers 84*a*-84*d*. FIGS. 32-36 include reference numbers 85*a*-85*d*. FIGS. 37-41 include reference numbers 86*a*-86*d*. FIGS. 42-46 include reference number 87*a*-87*d*. FIGS. 47-51 include reference number 89*c* since there is only one portion and no internally-threaded blind holes.

Figure 52:
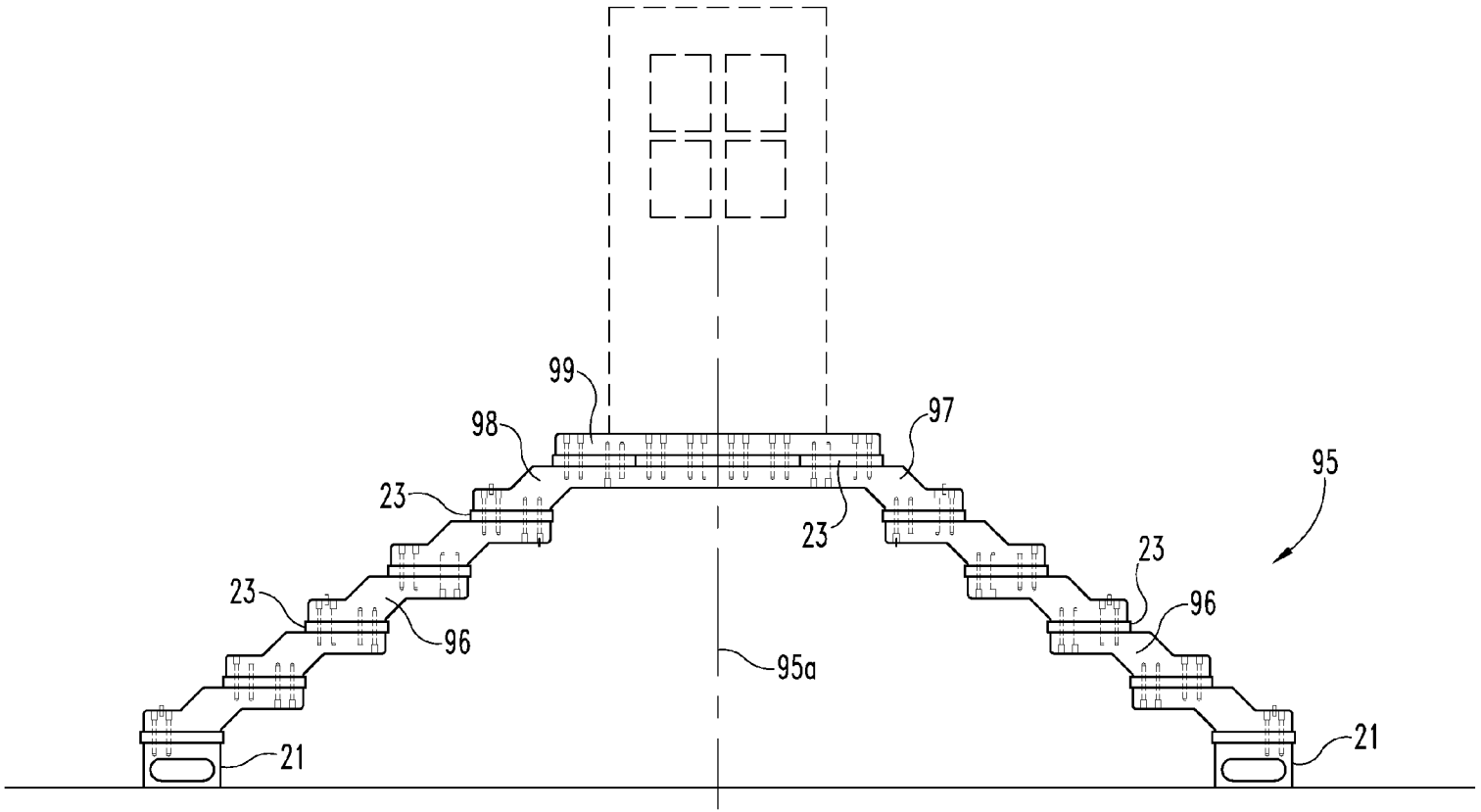
FIG. 52 is a side elevational view of a bridge stairway according to another embodiment of the present disclosure.

Referring now to FIG. 52, bridge stairway 95 is illustrated. Bridge stairway 95 is constructed and arranged to be symmetrical about centerline 95*a* and includes a left side series of risers 96 in alternating sequence with a series of treads 23. Similarly and symmetrically configured, there is a right side series of risers 96 in alternating sequence with a series of treads 23 and the right side construction essentially matches the left side construction. Each base 21 is constructed and arranged to be the same as base 21 illustrated in FIGS. 1 and 24-26. The treads 23 are the same as illustrated in FIGS. 19-21. However, the risers 96 have a slightly different styling from risers 22 and 22*d* (see FIG. 18). Riser 96 provides an example of yet another design variation for the risers of the present disclosure while still maintaining the feature of having a dual purpose. One purpose of the risers is to provide support for a tread 23 which rests on an upper portion of the riser. Another purpose is to use the lower portion of the riser to clamp the next lower tread to its supporting riser. Socket head cap screws are inserted into the counterbored clearance holes of one riser and securely thread into the internally-threaded blind holes of an adjacent riser. This clamping captures the tread between the two referenced risers.

Similar to how landing 27 is configured, bridge stairway 95 has a pair of landing risers 97 and 98. These two landing risers are essentially the same and turned end-to-end for abutment at or about centerline 95*a*. The upper portion of each landing riser 97 and 98 supports two treads 23, four total, which are clamped in position using clamping riser 99. Clamping riser 99 is similar in construction and essentially identical in use and function to clamping riser 89.

Bridge stairway 95 is shown as being used to provide access to an elevated location where a door/doorway (broken line) is denoted. This would allow one to walk up a series of steps/stairs from either side of a room. Another option for bridge stairway 95 is to be able to walk over an object such as an outdoor pond or pool.

Figure 55:
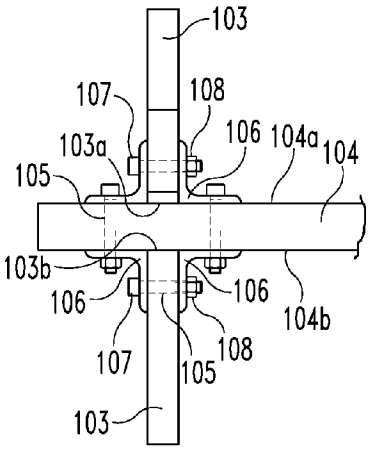
FIG. 55 is a partial front elevational view of the FIG. 53 step structure.
Figure 54:
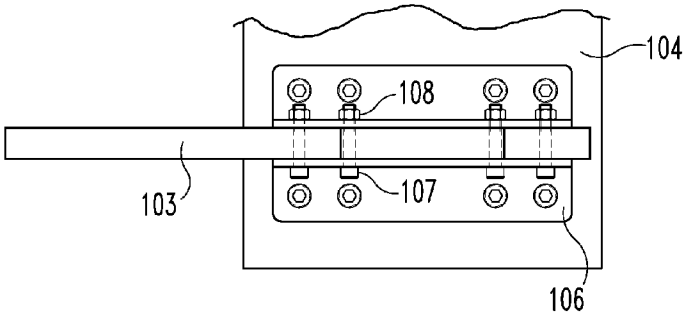
FIG. 54 is a partial top plan view of the FIG. 53 step structure.
Figure 53:
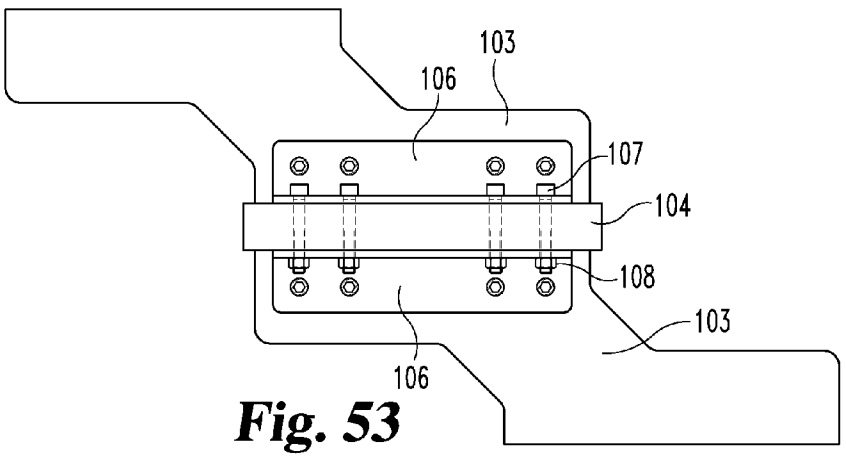
FIG. 53 is a diagrammatic, side elevational view of an alternate step structure incorporating alternate mounting means for the riser and tread.

Referring now to FIGS. 53-55, an alternative design for securely connecting together cooperating risers 103 and for clamping a tread 104 therebetween is illustrated. Instead of the use of counterbored clearance holes and internally-threaded blind holes, the risers 103 and treads 104 simply have clearance holes 105 and use L-shaped corner brackets 106. Except for the change in mounting hole types and hole locations, risers 103 are the same as the other risers disclosed herein, specifically riser 22. Similarly, except for the change in clearance hole locations, tread 104 is the same as tread 23.

As is illustrated, the top riser 103 has a lower planar surface 103*a* which abuts up against the upper planar surface 104*a* of the tread. This abutment (perpendicular) creates two interior corners and each interior corner receives a bracket 106. This assembly technique is repeated between the upper planar surface 103*b* of the lower riser 103 and the lower planar surface 104*b* of the tread 104. Two more brackets are assembled to those two interior corners. The threaded fasteners 107 extend through each pair of facing brackets and are secured as illustrated using hex nuts 108.

Figure 58:
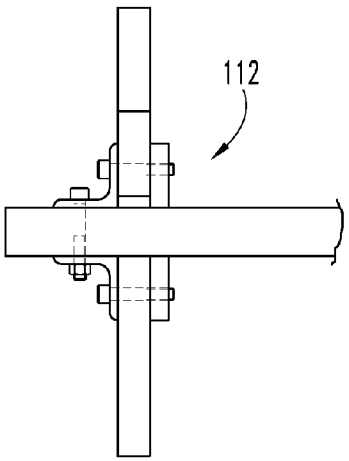
FIG. 58 is a partial, front elevation view of the FIG. 56 alternative.
Figure 57:
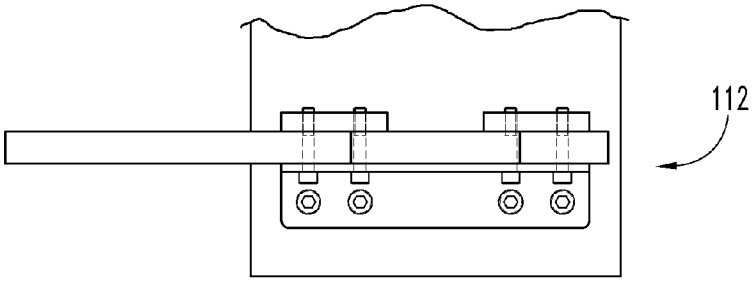
FIG. 57 is a partial, top plan view of the FIG. 56 alternative.
Figure 56:
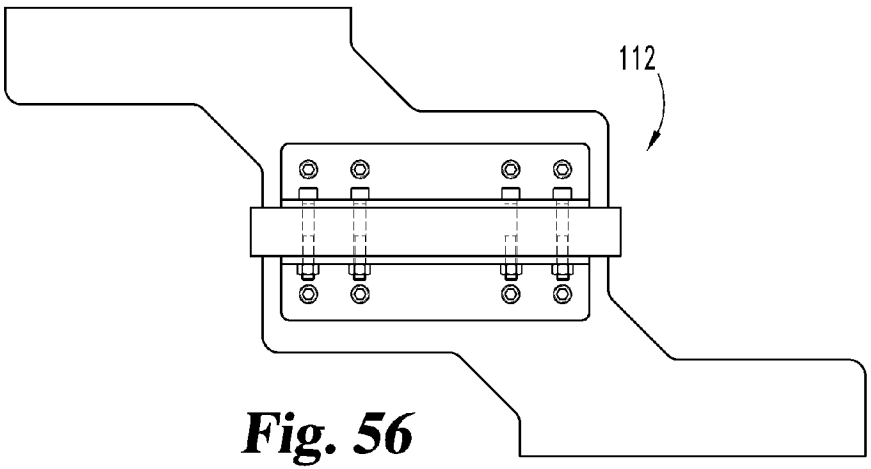
FIG. 56 is a diagrammatic side elevational view of another riser and tread mounting arrangement which provides yet a further alternative according to the present disclosure.
Figure 61:
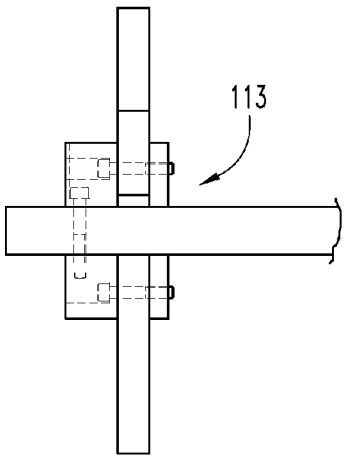
FIG. 61 is a partial, front elevation view of the FIG. 59 alternative.
Figure 59:
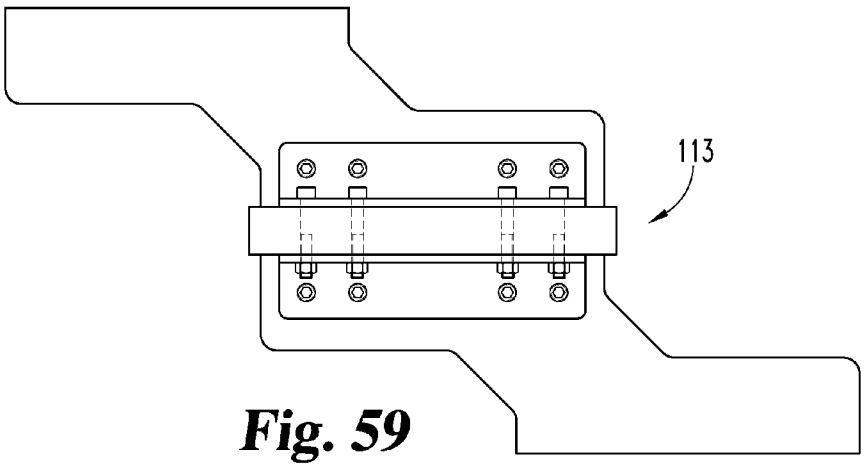
FIG. 59 is a diagrammatic side elevational view of another riser and tread mounting arrangement which provides yet a further alternative according to the present disclosure.
Figure 60:
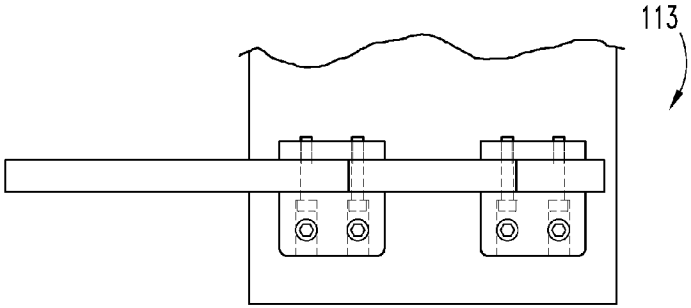
FIG. 60 is a partial, top plan view of the FIG. 59 alternative.
Figure 63:
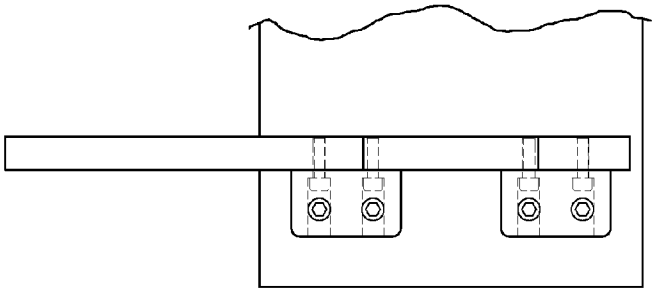
FIG. 63 is a partial, top plan view of the FIG. 62 alternative.
Figure 62:
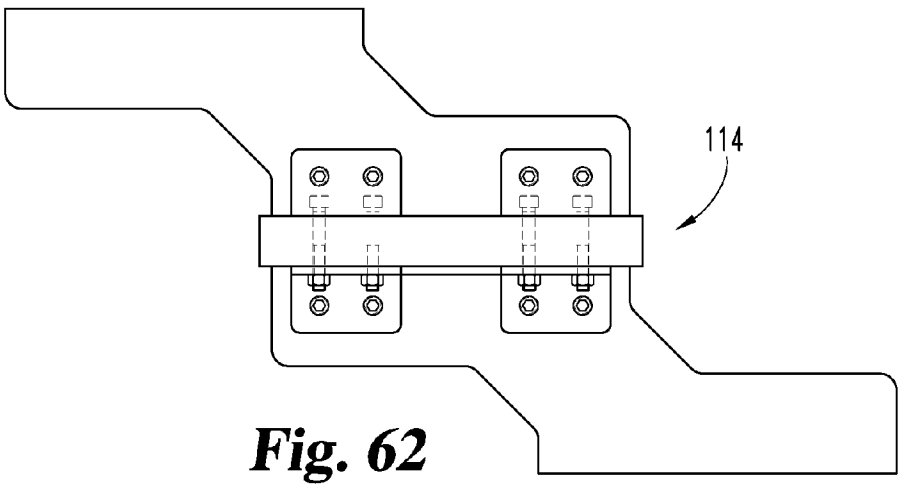
FIG. 62 is a diagrammatic side elevational view of another riser and tread mounting arrangement which provides yet a further alternative according to the present disclosure.
Figure 64:
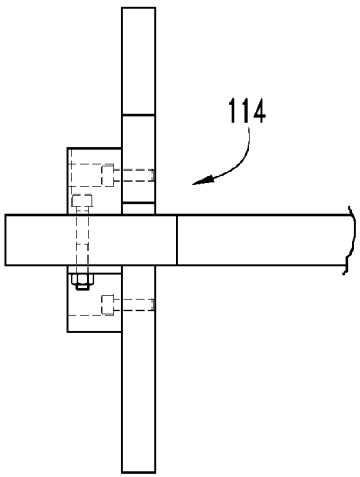
FIG. 64 is a partial, front elevation view of the FIG. 62 alternative.

Diagrammatically illustrated in FIGS. 56-58 is another alternative mounting and assembly arrangement 112. It is intended that what is illustrated in FIGS. 56-58 is essentially the same as what is illustrated in FIGS. 53-55, noting the obvious differences in choices as to the specific mounting and connection arrangement. Diagrammatically illustrated in FIGS. 59-61 is another alternative mounting and assembly arrangement 113. It is intended that what is illustrated in FIGS. 59-61 is essentially the same as what is illustrated in FIGS. 53-55, noting the obvious differences in choices as to the specific mounting and connection arrangement. Diagrammatically illustrated in FIGS. 62-64 is another alternative mounting and assembly arrangement 114. It is intended that what is illustrated in FIGS. 62-64 is essentially the same as what is illustrated in FIGS. 53-55, noting the obvious differences in choices as to the specific mounting and connection arrangement.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A step structure for use in constructing a stairway, the step structure comprising:

a first riser having a front portion and a rear portion;

a tread having a support surface and an opposite surface, the tread defining an aperture;

a compression spacer received within the aperture;

a second riser having a front portion and a rear portion;

a fastener received within the aperture and clamping together the first and second risers; and wherein the tread is fastened between the rear portion of the first riser and the front portion of the second riser and wherein the second riser of one step structure becomes the first riser of the next-up step structure and wherein the compression spacer is constructed and arranged to absorb at least a portion of the clamping force of the fastener.

2. The step structure of claim 1, wherein each riser defines a clearance hole and an internally-threaded hole and wherein the fastener extends through the clearance hole and another fastener extends through the clearance hole and is received by the internally threaded hole.

3. The step structure of claim 1, wherein each riser is a unitary member.

4. The step structure of claim 3, wherein the front portion of each riser includes a substantially flat tread-facing surface.

5. The step structure of claim 4, wherein the rear portion of each riser includes a substantially flat tread-facing surface.

6. The step structure of claim 5, wherein the tread-facing surface of the front portion is substantially parallel to the tread-facing surface of the rear portion.

7. The step structure of claim 1, further including a third riser used in side-to-side alignment with the first riser and a fourth riser used in side-to-side alignment with the second riser.

8. A stairway including a plurality of step structures according to claim 1, the stairway further including a base constructed and arranged for positioning on a support surface and a landing constructed and arranged for terminating the stairway at an elevated location, wherein the plurality of step structures are connected in series between the base and the landing.

9. The step structure of claim 1 wherein the compression spacer is fabricated out of a first material and the tread is fabricated out of a second material, the first material being less compressible than the second material.

10. The step structure of claim 1 wherein the tread has a thickness and the compression spacer has a thickness substantially equal to the tread thickness.

11. The step structure of claim 10 wherein the compression spacer is fabricated out of a first material and the tread is fabricated out of a second material, the first material being less compressible than the second material.

12. The step structure of claim 11 wherein the compression spacer is a separate block of metal.

13. A stairway comprising:

a base constructed and arranged for positioning on a support surface;

a landing constructed and arranged for terminating the stairway at an elevated location, the landing including a first plurality of treads and a landing riser that is constructed and arranged to support the first plurality of treads;

a plurality of step risers connected together with compression-inducing members;

a second plurality of treads constructed and arranged in alternating sequence with the plurality of step risers wherein the alternating sequence of treads and step risers is positioned between the base and the landing;

each tread of the first and second pluralities of treads defining at least one aperture;

a plurality of compression spacers received by the plurality of apertures, each compression spacer being constructed and arranged to absorb at least a portion of the compression force of the compression-inducing member, and the compression-inducing members are received by the plurality of apertures; and each step riser of the plurality of step risers having a front portion and a rear portion, wherein each tread of the second plurality of treads is positioned between the front portion of a first step riser and the rear portion of a second step riser, the second step riser being positioned between the first step riser and the base.

14. The stairway of claim 13, wherein the compression-inducing member is a fastener.

15. The stairway of claim 14, wherein each step riser defines a clearance hole and an internally-threaded hole and wherein one fastener extends through the clearance hole and the internally-threaded hole receives another fastener.

16. The stairway of claim 15, wherein each step riser is a unitary member.

17. The stairway of claim 16, wherein the front portion of each step riser includes a substantially flat tread-facing surface.

18. The stairway of claim 17, wherein the rear portion of each riser includes a substantially flat tread-facing surface.

19. The stairway of claim 18, wherein the tread-facing surface of the front portion is substantially parallel to the tread-facing surface of the rear portion.

20. The stairway of claim 13 wherein each compression spacer of the plurality of compression spacers is a separate block of metal that is less compressible than the treads of the first and second plurality of treads.

* * * * *